US005340395A

United States Patent [19]

Larmignat et al.

[11] Patent Number: 5,340,395

[45] Date of Patent: Aug. 23, 1994

[54] MATERIAL FOR EFFICIENT MASKING IN THE INFRARED REGION

[75] Inventors: Daniel Larmignat, Plaimpied; Phillippe C. Morand, Allouis; Christian H. Prieur, Somme; Gilles F. Lacreuse, Saint-Etienne, all of France

[73] Assignee: Giat Industries, Cedex, France

[21] Appl. No.: 877,182

[22] PCT Filed: Nov. 21, 1991

[86] PCT No.: PCT/FR91/00920

§ 371 Date: Jul. 1, 1992

§ 102(e) Date: Jul. 1, 1992

[87] PCT Pub. No.: WO92/09544

PCT Pub. Date: Jun. 11, 1992

[30] Foreign Application Priority Data

Nov. 22, 1990 [FR] France ..... 90 14561

[51] Int. Cl.[5] ..... C09C 1/00; F42B 12/48; C06D 3/00

[52] U.S. Cl. ..... 106/504; 106/403; 106/404; 106/425; 106/426; 106/431; 106/453; 106/472; 106/475; 106/477; 106/480; 106/481; 106/483; 106/489; 106/499; 106/285; 102/208; 102/334; 250/338.1; 252/305; 428/403; 428/404; 428/406; 428/407

[58] Field of Search ..... 106/403, 404, 425, 426, 106/431, 432, 435, 436, 442, 450, 452–457, 472, 475, 477, 479, 480, 481, 483, 489, 499, 504, 285; 102/334; 250/338.1; 428/403, 404, 406, 407, 432, 433, 450, 469, 472, 689, 699, 701, 919

[56] References Cited

U.S. PATENT DOCUMENTS

| | | | |
|---|---|---|---|
| H360 | 11/1987 | Shukis et al. | 102/334 |
| H769 | 4/1990 | Rouse et al. | 102/334 |
| 2,408,429 | 10/1946 | Levey | 252/305 |
| 2,913,419 | 4/1956 | Alexander | 252/313.2 |
| 2,939,779 | 6/1960 | Brock | 149/76 |
| 3,849,152 | 11/1974 | Mimeault | 524/406 |
| 4,484,195 | 11/1984 | Shaffer | 250/338.1 |
| 4,568,820 | 2/1986 | Swiatosz | 219/272 |
| 4,808,230 | 2/1989 | Bugnon et al. | 106/483 |

FOREIGN PATENT DOCUMENTS

| | | | |
|---|---|---|---|
| 0037515 | 10/1981 | European Pat. Off. . | |
| 3147850 | 6/1983 | Fed. Rep. of Germany . | |
| 826911 | 4/1938 | France . | |
| 2396265 | 1/1979 | France . | |
| 47-023319 | 6/1972 | Japan | 106/454 |
| 52-36861 | 3/1977 | Japan . | |
| 58-077505 | 5/1983 | Japan . | |
| 61-266456 | 11/1986 | Japan . | |
| 62-153337 | 7/1987 | Japan . | |
| WO88/08954 | 11/1988 | PCT Int'l Appl. . | |
| 854966 | 8/1981 | U.S.S.R. | 106/426 |
| 1502535 | 8/1989 | U.S.S.R. . | |
| 1555883 | 11/1979 | United Kingdom . | |

*Primary Examiner*—Anthony Green
*Attorney, Agent, or Firm*—Oliff & Berridge

[57] ABSTRACT

The technical field of the invention is concerned with smoke-generating devices and with powdered materials scattered by dispersion means in order to produce a camouflaging cloud which is effective in the infrared region. The material in accordance with the invention essentially consists of at least one powder having grains provided with a coating which is chemically inert with respect to the grain, which affords resistance to temperatures lower than or equal to the dispersion temperature, and which does not oxidize in free air.

21 Claims, 1 Drawing Sheet

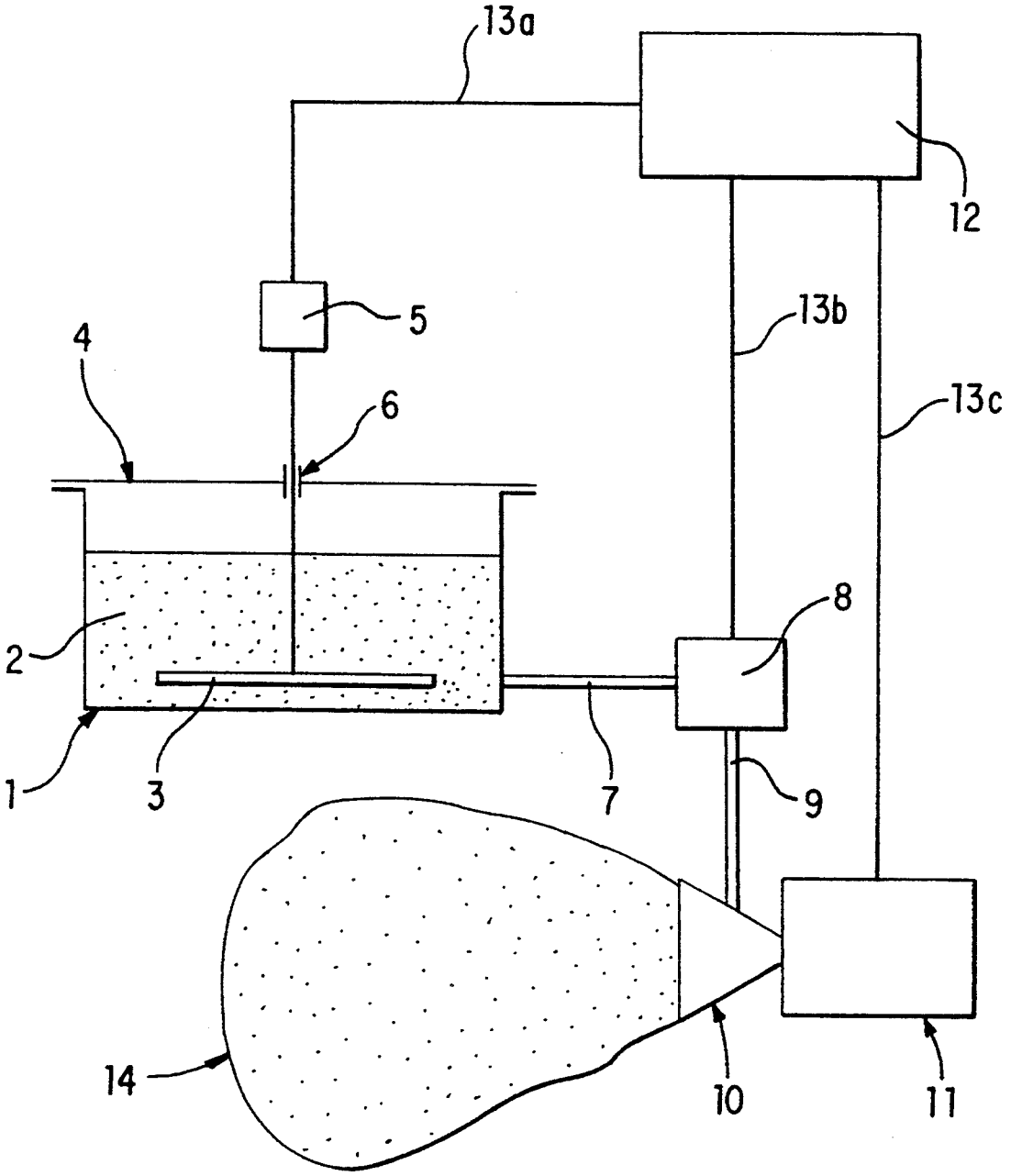
13a
12
5
13b
4
6
13c
8
2
1
3
7
9
14
10
11

MATERIAL FOR EFFICIENT MASKING IN THE INFRARED REGION

The present invention is concerned with the field of powdered materials which are intended to be scattered by dispersion means in order to produce a camouflaging cloud.

Smoke-producing compositions which have an effective action in the visible region of the spectrum (from 0.4 μm to 0.8 μm) have already been known for a long time. In the majority of instances, these compositions include an oxidizing agent associated with a reducing agent and with a sublimable compound. Reference will be made, for example, to patent U.S. Pat. No. 2,939,779 which describes a composition having a base of hexachloroethane and zinc oxide.

The reaction between these two compounds produces a grey smoke screen which is not capable, however, of masking the transmission of infrared radiation (wavelength of 0.8 μm to 14 μm). In addition, the compound obtained is highly corrosive and toxic.

Statutory Invention Registration USH769 proposes to carry out masking in the optical field by means of titanium dioxide particles having a particle size of the order of 0.3 micrometer. These particles are coated with siloxane with a view to preventing detonation of the cloud which is formed. The masking effect thus obtained fails to prevent transmission of infrared radiation.

It is also known to produce mists of fine droplets by vaporizing oils by means of gas compressors but these mists are also transparent in the infrared region.

Patent FR2396265 proposes to disperse the solid particles of a mineral powder by means of a propellant gas.

When the mean particle size of the powder is uniform and close to the wavelength of the radiation to be occulted, infrared masking can in fact be obtained but it has been found that, when the particles described in this patent were dispersed in the cold state, agglomeration of the particles occurred and had an adverse effect on the requisite opacity.

It has also been sought to obtain masking both in the visible and infrared regions by vaporizing an oil charged with a mineral powder.

For example, patent U.S. Pat. No. 4,484,195 describes a smoke-producing device in which a turbine is employed for dispersing aluminum particles mixed with gas oil.

A device of this type is very disappointing since the aluminum particles undergo considerable degradation at the time of dispersion.

Statutory Invention Registration USH360 describes a smoke-producing grenade which is effective in the infrared region and involves the use of fine particles of brass or aluminum placed in a volatile liquid. This arrangement makes it possible to reduce the dispersion energy and prevents agglomeration of the particles.

In point of fact, prevention of particle agglomeration is not sufficiently effective and the infrared masking performances obtained are unsatisfactory. Furthermore, a grenade of this type is capable of masking only small areas over a limited period of time.

SUMMARY OF THE INVENTION

A primary aim of the invention is to provide a powdered material having the intended function of producing smokes which achieve better infrared masking than materials employed in the prior art.

The invention also proposes a smoke-generating device which is adapted to this type of material.

Thus the invention is concerned with powdered material which is intended to be scattered by dispersion means in order to produce a camouflaging cloud which is effective in the infrared region. The distinctive feature of this material is that it includes at least one powder having grains provided with a coating which is chemically inert with respect to the grain, which is resistant to temperatures lower than or equal to the dispersion temperature and which does not oxidize in free air.

BRIEF DESCRIPTION OF THE DRAWING

The drawing figure shows a device according to the invention for dispersing the powdered material to form a smoke screen.

DETAILED DESCRIPTION OF PREFERRED EMBODIMENTS

The coating considered can be a compound of silica and alumina and the mean particle size selected for the coated powder will be within the range of 1 μm to 15 μm.

The powder may contain at least one of the following constituents: iron, aluminum, zinc, boron, copper, chromium, alloys or oxides of these metals, carbon, polytetrafluoroethylene.

Preferably, the powder is a brass powder having a mean particle size within the range of 1 μm to 15 μm after coating.

The invention is also concerned with a smoke-generating device in which the material is in suspension in a carrier liquid. In this case, the coating is chosen with a view to ensuring that it does not oxidize in contact with this liquid and at temperatures lower than or equal to the dispersion temperature.

The carrier liquid may be selected from the following compounds: gas oil, low-viscosity oil.

The device preferably contains a mass of 50 g to 250 g of powdered material per liter of gas oil.

The dispersion means will comprise at least one hot gas generating turbine equipped with a discharge nozzle, a storage tank which is equipped with a mixer and receives the powdered material in suspension in the carrier liquid, the storage tank being connected to the discharge nozzle via an electric pump.

As an advantageous feature, control of the turbine is permitted only when the mixer is in operation.

A more complete understanding of the invention will be gained from the following description of a particular embodiment, reference being made to the accompanying drawings in which a smoke-generating device adapted to disperse the material in accordance with the invention is illustrated diagrammatically.

As has already been stated in the introductory part of the present description, it is a known practice to make use of metallic or mineral powders for the purpose of forming a smoke screen which is opaque to infrared radiations. Metallic powders are particularly advantageous since they efficiently reflect the infrared radiation received from the target which it is sought to mask.

The powder placed within a vessel is dispersed by means of a propellant gas (such as nitrogen, carbon dioxide or compressed air), the gas being admitted into the vessel via a pipe and the vessel being provided with another opening in the form of a discharge nozzle in order to produce a fine dispersion of the powder. A device of this type is described in patent FR2396265.

It is also known to mix the powder with a carrier liquid (in most cases a mineral oil) which will be vaporized by hot air through a discharge nozzle. This makes it possible to obtain a cloud of longer duration which also has the effect of masking the visible region (droplets smaller in size than 1 μm).

Patent WO8808954 describes a device of this type.

The use of hot air for completely vaporizing mineral oil (at a temperature of the order of 400° C.) leads to the choice of particles having good temperature stability such as brass or copper powders.

It is found in all cases, however, that the infrared masking performances are unsatisfactory. Thus it has been observed that brass powder having a mean particle size within the range of 1 μm to 15 μm and dispersed with gas oil by means of hot air made it possible to obtain a coefficient of camouflage of only 30% in the case of a target at 200° C. as viewed by an 8 μm–12 μm thermal camera at 1000 meters.

In order to carry out infrared masking, consideration has accordingly been given to the use of powdered material which was commercially available as a coloring additive for paints or for plastics.

Patents U.S. Pat. No. 3,849,152 and U.S. Pat. No. 2,913,419 describe the modes of production of coated colored pigments of this type.

The first of these documents describes metallic pigments coated with silica or else with polysiloxane and the second document shows metallic particles coated with a metallic silicate.

The preferred metallic pigments are grains of brass coated with a protective vitreous layer and are marketed by the Eckart Company under the trade name "Resist Rotoflex".

Although it could have been feared that a coating of this type would result in poor masking on account of the modification of the reflecting power of uncoated brass, it has been found surprisingly that good masking was achieved within the range of 0.8 μm to 15 μm for camouflaging of all known thermal targets of modern combat areas.

By way of example, masking of a heat source in the vicinity of 200° C. by means of an Eckart Resist brass powder has thus been compared with the masking action produced by an uncoated brass powder.

In both cases the powders were mixed with gas oil and dispersed at a temperature of the order of 400° C. by a turbine of the type described hereinafter.

The result was observed by means of an 8–12 micrometer thermal camera. It was found that the coated brass powder produced total and continuous occultation of the infrared radiation (coefficient of camouflage of 100%) whilst the uncoated brass masked the heat source with a coefficient of camouflage of only 30%, all operating conditions being otherwise identical.

This behavior is due to the fact that coating prevents degradation of the grain of brass both during storage (in free air or in mineral oil) and during its dispersion by hot air.

Thus, since surface oxidation of the metallic powder grains is prevented, the mean particle size remains invariable even during a dispersion at high temperature (of the order of 400° C.).

Furthermore, the electrical insulating capacities of the coating prevents any agglomeration of the brass grains when they are being dispersed and any resultant modification of the mean particle size after dispersion.

On the basis of these observations, it is possible to define other powdered materials which are suited to infrared masking by smoke generation.

The characteristics of the coating which is suited to the application in accordance with the invention are as follows:

It must be chemically inert with respect to the metallic grain in order to prevent the formation of any product which would be liable to modify the shape or size of the grain.

It must withstand temperatures lower than or equal to the dispersion temperature. In the majority of instances, this limiting temperature is 500° C. (temperature of the hot air employed for dispersion).

It must not oxidize during long periods of storage, in particular in the open air.

In the case of dispersion by means of a carrier (such as a mineral oil), a further requirement is that it must not oxidize in contact with the carrier and at temperatures lower than or equal to the dispersion temperature.

The majority of refractory materials or ceramics are suited to the application considered, such as products having a base of silica (at least 91% silica $SiO_2$), siliceous products (85% to 93% silica and more than 5% alumina), compounds having a base of alumina or organic compounds of silicon (such as the polysiloxanes).

The glasses or vitreous products which contain a mixture of silica and alumina are also well suited.

Methods of coating of metallic grains are known for example in the technical field of pigments for paints and reference can be made to patent GB1555883 granted to the Eckart Company which describes a mode of formation of a vitreous layer on metallic pigments as well as to patents U.S. Pat. No. 3,849,152 and U.S. Pat. No. 2,913,419 cited earlier.

Other methods of coating are known such as dispersion of fused alumina in a gas stream (patent SU1502535), plasma vapour deposition of silica (patents J62153337 and J61266456), coating of particles with silicone oil followed by reduction of the oil at high temperature (>350° C.) (patents J77036861 and J58077505).

A further advantage of the application in accordance with the invention of a coated powder to the manufacture of smoke-producing masking materials which are effective in the infrared region is that it becomes possible to employ metallic powders having lower temperature resistance than that of copper or brass (e.g. aluminum).

The coating will ensure stability of the mean particle size of aluminum even after dispersion by mineral oil vaporized at 400° C.

Another advantage is that the known methods of coating can be adapted to powders of nonmetallic materials such as plastics or else carbon.

In order to carry out infrared masking, it thus becomes possible to employ materials of lighter weight than metallic powders with the result that a longer time-duration of the cloud will accordingly be ensured. Provision can be made, for example, for a coating of graphite or of polytetrafluoroethylene (better known under the trade name Teflon).

The accompanying figure shows a device which is designed to disperse the powdered material in order to form a smoke screen.

The device comprises a tank 1 which is closed by a cover 4 and within which is placed the powdered material mixed with a carrier liquid 2.

Said carrier liquid is chosen in a known manner from compounds such as gas oil or low-viscosity oils (viscosity below 13 Centistokes at 37.8° C.).

These compounds are distinguished by the fact that they can be vaporized in fine droplets (of the order of one micron) by a stream of hot air (of the order of 400° C.).

It will be preferable to make use of a gas oil containing in suspension a mass of 50 to 250 grammes of powdered material per liter of gas oil.

A pipe 7 connects the bottom of the tank so an electric pump 8 and another pipe 9 conveys the suspension of material in the carrier liquid to a dispersion nozzle 10.

The nozzle just mentioned serves to vaporize the carrier liquid which transports the grains of infrared masking material and therefore to produce a cloud 14.

Said nozzle is placed at the discharge end of a turbine 11 of known type which will not be described in greater detail and which produces a stream of hot air (temperature of the order of 400° C. and air flow rate of the order of 1 cubic meter per second).

In order to ensure homogeneity of the suspension of powdered material in the carrier liquid, the storage tank 1 is provided with a mixer 3 having two paddles carried by a shaft which passes through the cover 4 at the level of a bearing 6. The mixer is actuated by an electric motor 5.

A unit 12 is intended to control the operation of the dispersion device by means of electrical connections 13*a*, 13*b* and 13*c*.

The operation of the device is as follows:

The motor 5 of the mixer is first started-up.

A wired-logic system (not shown) of the control unit prevents any start-up of the turbine if the mixer is not operating, thus guaranteeing homogeneity of the suspension at the moment of its dispersion.

The turbine 11 is then in turn started-up.

When the temperature of the air discharged by the turbine, which is measured by suitable means at the level of the turbine, attains the value required to ensure that the carrier liquid can be vaporized, another wired-logic system of the control unit permits operation of the electric pump 8, the action of which results in emission of the camouflaging cloud 14.

A device of this type is preferably installed on a vehicle, the mobility of which permits rapid formation of large-sized camouflage screens.

It is also possible to provide means for varying the flow rate of the mixture which arrives at the nozzle (electronic adjustment of the output of the electric pump or bank of electric pumps in parallel).

This permits optimization of the quantity of solid/liquid mixture as a function of the temperature of the target to be camouflaged.

What we claim is:

1. A material for producing an infrared-masking camouflaging cloud, comprising:

a carrier liquid comprising a mineral oil; and a coated powder suspended in said carrier liquid, said coated powder having a mean particle size of 0.8 μm to 15 μm and comprising infrared-opaque grains provided with a coating that is chemically inert with respect to the grains, is resistant to temperatures up to 400° C., and does not oxidize in said carrier liquid at temperatures up to 400° C.

2. A material of claim 1, wherein said coating is resistant to temperatures up to 500° C., and does not oxidize in said carrier liquid at temperatures up to 500° C.

3. A material of claim 1, wherein said coated powder is present in an amount of 50 g to 250 g per liter of said carrier liquid.

4. A material of claim 1, wherein said mean particle size is 1.0 μm to 15 μm.

5. A material of claim 1, wherein said mineral oil is at least one member selected from the group consisting of gas oil and low-viscosity oil.

6. A material of claim 1, wherein the coating is selected from the group consisting of ceramics and glasses.

7. A material of claim 1, wherein the coating is comprised of silica and alumina.

8. A material of claim 1, wherein the grains are comprised of: a metal selected from the group consisting of iron, aluminum, zinc, boron, copper, and chromium; an alloy of said metal; an oxide of said metal; carbon; or polytetrafluoroethylene.

9. A material of claim 1, wherein the coated powder is a coated brass powder.

10. A method of producing an infrared-masking camouflaging cloud, comprising:

dispersing in air at a dispersion temperature a material comprising a coated powder having a mean particle size of 0.8 μm to 15 μm, said coated powder comprising infrared-opaque grains provided with a coating that is chemically inert with respect to the grains, is resistant to temperatures up to said dispersion temperature, and does not oxidize in ambient air.

11. A method of claim 10, wherein said coating is resistant to temperatures up to 500° C.

12. A method of claim 10, wherein said mean particle size is 1.0 μm to 15 μm.

13. A method of claim 10, wherein the coating is selected from the group consisting of ceramics and glasses.

14. A method of claim 10, wherein the coating is comprised of silica and alumina.

15. A method of claim 10, wherein the grains are comprised of: a metal selected from the group consisting of iron, aluminum, zinc, boron, copper, and chromium; an alloy of said metal; an oxide of said metal; carbon; or polytetrafluoroethylene.

16. A method of claim 10, wherein the coated powder is a coated brass powder.

17. A method of claim 10, wherein said material comprises said coated powder suspended in a carrier liquid, and said coating does not oxidize in contact with said carrier liquid at temperatures up to said dispersion temperature.

18. A method of claim 17, wherein said carrier liquid comprises a gas oil or a low-viscosity oil.

19. A method of claim 17, wherein said coated powder is present in an amount of 50 g to 250 g per liter of said carrier liquid.

20. A system for producing an infrared-masking camouflaging cloud, comprising a storage tank equipped with a mixer, said storage tank containing a material according to claim 2, an electric pump, and at least one hot gas generating turbine equipped with a nozzle; said storage tank being in fluid communication with said nozzle via said electric pump.

21. A system of claim 20, further comprising means for preventing operation of the turbine when the mixer is not operating.

* * * * *